United States Patent [19]

Then et al.

[11] 4,136,917

[45] Jan. 30, 1979

[54] MULTIPLE-CONTACT CONNECTOR FOR A PRINTED CIRCUIT BOARD

[75] Inventors: Gebhard Then, Bad Neustadt, Gerhard Spiller, Saal, both of Fed. Rep. of Germany

[73] Assignee: Preh, Elektro-Feinmechanische Werke, Jakob Pre Nachf, Bad Neustadt, Fed. Rep. of Germany

[21] Appl. No.: 797,562

[22] Filed: May 16, 1977

[30] Foreign Application Priority Data

May 18, 1976 [DE] Fed. Rep. of Germany ..... 2621984

[51] Int. Cl.[2] ..... H01R 13/54; H05R 1/07

[52] U.S. Cl. ..... 339/17 L; 339/91 R; 339/176 MP; 361/415

[58] Field of Search ..... 339/17 L, 75 M, 75 MP, 339/91 R, 176 MP; 361/399, 413, 415

[56] References Cited

U.S. PATENT DOCUMENTS

| | | | |
|---|---|---|---|
| Re. 26,692 | 10/1969 | Ruehlemann | 339/17 L X |
| 3,701,071 | 10/1972 | Landman | 339/176 MP X |
| 3,795,888 | 3/1974 | Nardo et al. | 339/17 L X |
| 3,848,952 | 11/1974 | Tighe | 339/176 MP X |
| 3,920,303 | 11/1975 | Pittman et al. | 339/176 MP X |

*Primary Examiner*—Roy Lake
*Assistant Examiner*—E. F. Desmond
*Attorney, Agent, or Firm*—Thomas E. Beall, Jr.

[57] ABSTRACT

A housing made of insulating material has a plurality of slots each accommodating a contact spring including a pair of legs. The free ends of each leg are formed as contact noses facing each other. The contact noses define an opening through which an edge of a printed circuit board may be inserted with the board held at an angle with respect to its final position. The printed circuit board is then rotated about an axis parallel to the edge into its final position in which it is locked by a pair of resilient detent tongues formed at the ends of the housing. In this final position, conductor strips provided at the inserted edge of the printed circuit board make electrical contact with the noses of the contact springs. During rotation of the circuit board, minute sliding movements occur at the contact locations providing a cleaning effect on the contacts without causing excessive wear thereof.

14 Claims, 3 Drawing Figures

MULTIPLE-CONTACT CONNECTOR FOR A PRINTED CIRCUIT BOARD

BACKGROUND OF THE INVENTION

This invention relates to a multiple contact connector for a printed circuit board, the connector comprising a plurality of contact springs for contacting conductor strips provided at an edge portion of the circuit board.

Printed circuit boards consisting of a ceramic substrate have tolerances in length and thickness caused in the production process. Particularly, circuit boards of this type are not entirely plane but are slightly curved. In order to ensure safe contacts even under critical tolerances in thickness, the contact springs are selected to exert relatively high contact pressures on the circuit board. As a result, when the circuit board is inserted into the connector, high friction occurs on at least some of the conductor strips over a long distance, which may cause damage to the conductor strips after several inserting actions. Moreover, the edge of such circuit board is mostly very sharp as a consequence of the production process so that the precious metal layer by which the contact portions of the contact springs are covered is quickly chafed with the result that safe contact is no longer ensured when the circuit board has been exchanged a number of times.

Furthermore, modern circuitry requires high packing density according to which a great number of circuits are accommodated on a relatively small circuit board, for instance by employing thin film technology. This results in a great number of conductor strips formed at the edge of the circuit board which conductor strips are rather narrow and prone to friction wear.

Since as many conductor strips as possible are to be accommodated at small distances along the edge of the circuit board and since, on the other hand, the tolerances in the length of the board and thus the relative position of the conductor strips jeopardize a safe contacting, it is necessary for the circuit board to be inserted into the connector in such a manner that there is at least one fixed reference point from which the position of each conductor strip may be determined.

As an additional difficulty, the tolerance in the length of the circuit board caused by contraction in the production process varies from one manufacturer to the other, so that it is often impossible to change the circuit boards as desired.

For overcoming the above disadvantages, a plug-in connection is known in which the printed circuit board has at one edge metal lugs forming the terminals of the circuit. The multiple-contact connector includes a number of pairs of pins. When the circuit board is inserted into the housing, the pins are forced into the metal lugs from both sides of the circuit board thereby making the contact.

Another plug-in connection has been suggested in which a contact pressure is produced or released by a mechanism during inserting or removing the circuit board. An eccentric cam portion is disposed between the contact springs, by means of which the contact springs may be spread apart while inserting or removing the circuit board.

In another similar plug-in connection, the contacts between the circuit board and the contact springs are made by a cam switch provided in a housing on one side of the contact springs, which cam switch is rotated manually upon inserting the circuit board so as to force the contact springs against the conductor strip.

In a further known plug-in connection, the contact spring element is formed and mounted in a housing in such a way that the circuit board is brought into contact engagement by being deformed beyond a flexing point, the kinematic action being similar to that of a toggle joint. The actuating force required for the plug-in action is transmitted through a flexible coupling rather than directly from one part to another. The actuating force which acts originally only in the plugging direction, rises from zero to a maximum and then falls back to zero. At the maximum of the actuating force which firstly serves to deform the contact element, the flexing point is reached at which the contact of both parts is made. When the flexing point has been passed, the actuating force falls back to zero while the contact force is only slightly reduced.

The above known plug-in connections have the disadvantage that the spreading means require additional space, which is aggravated by the fact that the spreading means must be readily accessible for manual operation. As a further disadvantage, foreign matter that may affect the contacts is not removed by any wiping movement or small friction occurring over a small distance during inserting of the circuit board.

In a further known plug-in connection, forked contact springs are mounted in a housing for receiving a retaining bar inserted into a recess in the lower portion of the contact springs. Circuit boards of variable thickness can be accommodated by changing the retaining bars. Brackets are formed integrally at the sides of the retaining bar to compensate for different lengths of the circuit boards. While tolerances in thickness and length between individual circuit boards may be compensated for with such retaining bar, the fact that almost every circuit board is not totally plane but at least slightly curved, is still left out of consideration. As an additional disadvantage, a great number of different retaining bars must be available to be employed in accordance with the dimensions of the individual circuit board.

It is an object of the present invention to provide a multiple-contact connector for a printed circuit board which is free from the above disadvantages.

Another object of the invention is to provide a connector of the said type which allows easy and rapid inserting of a printed circuit board into the connector for making the required contacts.

A further object of the invention is the provision of a multiple-contact connector in which a printed circuit board automatically assumes an exact position with respect to the connector in a final locked position.

It is still a further object of the invention to make available a multiple-contact connector in which the circuit board is contacted with a small frictional movement occurring during inserting the contact board.

SUMMARY OF THE INVENTION

The multiple-contact connector for a printed circuit board according to this invention comprises a housing of insulating material and a plurality of contact springs disposed in the housing for contacting conductor means provided at an edge portion of the circuit board, an opening allowing the circuit board to be inserted at an angle with respect to its final contacting position, and detent means for locking the circuit board in its final position upon rotation parallel to the said edge. In this connector, only the last portion of the rotational movement of the circuit board takes place against the contact force of the contact springs, and in such final rotation, a very small sliding movement occurs between the contact springs of the connector and the conductor means of the circuit board. This small sliding movement is sufficient to have a cleaning effect on the contact areas while being small enough to avoid substantial wear.

Further aspects and advantages of the invention will become apparent from the following detailed description of a preferred embodiment with reference to the drawings.

DETAILED DESCRIPTION OF PREFERRED EMBODIMENT

Figure 2:
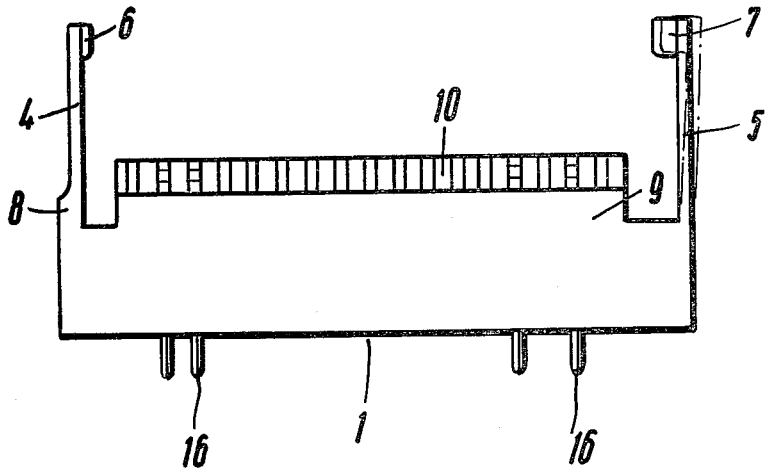
FIG. 2 is a side view of the connector of FIG. 1, as viewed from the right hand side of FIG. 3.
Figure 1:
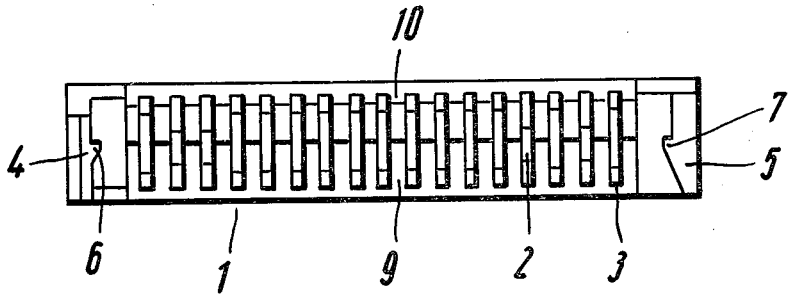
FIG. 1 is a top view of a multiple-contact connector according to this invention.

The connector shown in the drawings comprises a housing 1 of plastics material in which a plurality of contact springs 2 are disposed. The contact springs 2 are located in elongate slots 20 of the housing 1, and the edges 3 of the slots 20 are bevelled to facilitate the inserting of the contact springs 2. The connector is readily adapted to the number of conductor strips provided at the corresponding edge of a printing circuit board to be inserted by providing an according number of contact springs 2 in the respective slots 20. In FIGS. 1 and 2, a total of seventeen slots are shown, four of which are provided with contact springs 2. A saving in material with respect to the contact springs is thus achieved.

Figure 3:
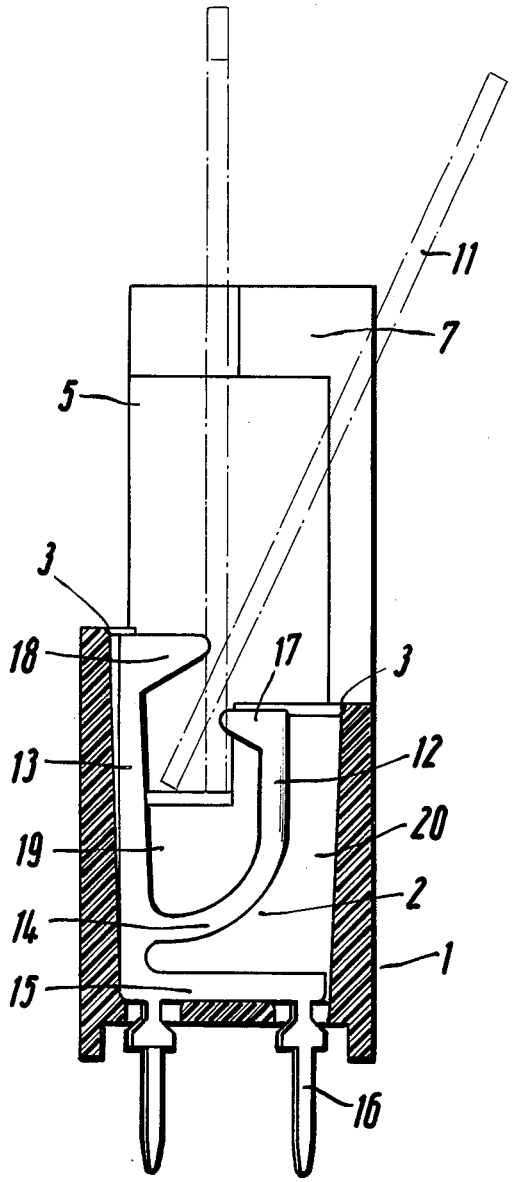
FIG. 3 is a cross-section of the connector of FIGS. 1 and 2 on an enlarged scale.

Resilient tongues 4, 5 are integrally formed at the small ends of the connector, which tongues have chamfering portions 6, 7 at their free ends. The chamfering portions 6, 7 are disposed on the inner sides of the tongues 4, 5 opposite to each other and have different lengths. The longer chamfering portion 7 starts at the small lateral edge of the tongue 5, while the shorter chamfering portion 6 begins at about the middle of the broad side of the tongue 4. Both chamfering portions 6, 7 are formed as detent noses and end in a common plane so that the printed circuit board indicated at 11 in FIG. 3 is locked in its final position by both detent noses.

The tongue 4 having the shorter chamfering portion 6 includes a base portion 8 which serves as a stop for the printed circuit board 11. The tongue 4 tapers towards its free end. In addition, the tongue 4 has a smaller width than the tongue 5. By this kind of shaping, the spring characteristics of both tongues 4, 5 are selected so that the tongue 4 having the shorter chamfering portion 6 provides a soft elasticity and the tongue 5 having the longer chamfering portion 7 provides a harder elasticity, so that the two tongues 4, 5 are deflected by different amounts when the printed circuit board 11 is rotated into its final position.

The longitudinal wall 9 of the housing 1 disposed on the side from which the printed circuit board 11 is inserted, is wider and lower than the other longitudinal wall 10. As shown in FIG. 3, the circuit board 11 is thus inserted into the opening of the connector at an angle with respect to its final position and subsequently rotated until it engages behind the detent noses in its final position. During this rotation, the two resilient tongues 4, 5 are deflected by different amounts, as mentioned above, and the circuit board 11 first slides along the longer chamfering portion 7, thereby being forced towards the base portion 8 of the tongue 4. This tongue 4 is deflected due to its softer elasticity as soon as the circuit board 11 starts to slide along its shorter chamfering portion 6. This action ensures that the printed circuit board 11 is always pressed against the base portion 8 as a stop or reference point.

The contact spring 2 is selected to have a fork-shape providing two spring legs 12 and 13. The leg 12 is connected through a curved portion 14 to the leg 13, and the leg 13 extends perpendicularly to a transverse web 15. Connecting lugs 16 are provided at both ends of the transverse web 15. That connecting lug 16 which is not used in a specific application may be selectively severed by some appropriate tool. The mutual spacing of the connecting lugs 16 is in accordance with a predetermined basic grid system.

On the free ends of the spring legs 12, 13 there are provided contact noses 17, 18 which face each other but are on different levels, the nose 17 being lower than the nose 18. Cooperating with the detent noses formed by the chamfering portions 6, 7, the contact nose 17 provided on the spring leg 12 provides the counter pressure to the contact nose 18 on the spring leg 13.

The contact spring 2 is located in the respective slot 20 of the housing 1 so that its leg 12 is adjacent to the wider longidtudinal wall 9 and the leg 13 is adjacent to the narrower longitudinal wall 10 of the housing 1. The connecting lugs 16 projecting outwardly of the housing 1 at the lower side thereof are slightly twisted to fix the contact spring 2 to the housing. The transverse web 15 and part of the spring leg 12 of the contact spring 2 are located in the elongate slot disposed in an elevated portion 19 of the bottom wall of the housing 1.

When the printed circuit board 11 is being inserted into the housing 1 in a tilted position until it reaches the elevated portion 19, the contact noses 17, 18 of the contact springs 2 are not contacted at first. Such contacting occurs only when the circuit board 11 is rotated, during which rotation a slight wiping effect occurs which is desired to remove foreign material from the contact areas.

What is claimed is:

1. A multiple-contact connector for a printed circuit board, comprising a housing of insulating material and a plurality of contact springs disposed in the housing for contacting conductor means provided at an edge portion of the circuit board, an opening allowing the circuit board to be inserted at an angle with respect to its final contacting position, detent means for locking the circuit board in its final position upon rotation about an axis parallel to said edge, said detent means being formed so as to produce a net axial force on the circuit board so as to press the circuit board in one direction of said axis into a reference position, and said detent means including first and second resilient tongues formed at opposite ends of said housing and having different spring characteristics so that upon their deflection they will produce the net axial force toward the referenced position.

2. The connector of claim 1, wherein said housing includes first and second opposite side walls, said second side wall being lower and wider than said first side wall, and slots for receiving said contact springs and spaced to match a basic grid system, the width and depth of said slots varying in accordance with the width and height of said first and second side walls.

3. The connector of claim 2, wherein each contact spring has first and second legs connected to each other and extending adjacent to said first and second side walls, respectively.

4. The connector of claim 1, wherein said first and second tongues are formed having chamfering portions facing each other.

5. The connector of claim 4, wherein said chamfering portions are provided at free ends of said first and second resilient tongues.

6. The connector of claim 4, wherein said chamfering portions have different lengths.

7. The connector of claim 6, wherein the longer one of said chamfering portions has a ramp surface beginning at a lateral edge of said first tongue and rising inwardly of said housing, and the shorter one of said chamfering portions has a ramp surface beginning at substantially the middle of said second tongue and rising inwardly of said housing.

8. The connector of claim 5, wherein said second tongue includes a base portion forming a stop for the circuit board and an extension of reduced cross-sectional area, said first tongue having the same length but greater width and thickness as compared to said second tongue.

9. The connector of claim 1, wherein each contact spring consists of an integral fork spring member including first and second legs, a curved portion connecting said second leg to said first leg, and a transverse web extending substantially perpendicularly to said first leg.

10. The connector of claim 9, including a pair of connecting lugs one formed at each end of said transverse web of each contact spring, said connecting lugs being spaced to match a basic grid system and adapted to be selectively severed from said web.

11. The connector of claim 9, including a projecting contact portion at the free end of each of said first and second legs, the two contact portions being disposed opposite to each other on different levels.

12. A multiple-contact connector for a printed circuit board, comprising a housing of insulating material and a pluraltiy of contact springs disposed in the housing for contacting conductor means provided at an edge portion of the circuit board, an opening allowing the circuit-board to be inserted at an angle with respect to its final contacting position, detent means for locking the circuit board in its final position upon rotation about an axis parallel to said edge, said detent means including first and second resilient tongues formed at opposite ends of said housing and having different length chamfering portions facing each other, the longer one of said chamfering portions having a ramp surface beginning at a lateral edge of said first tongue and rising inwardly of said housing, and the shorter one of said chamfering portions having a ramp surface beginning at substantially the middle of said second tongue and rising inwardly of said housing.

13. The conductor of claim 12, wherein said second tongue includes a base portion forming a stop for the circuit board and an extension of reduced cross-sectional area, said first tongue having the same length but greater width and thickness as compared to said second tongue.

14. A multiple-contact connector for a printed circuit board, comprising a housing of insulating material and a plurality of contact springs disposed in the housing for contacting conductor means provided at an edge portion of the circuit board, an opening elongated between opposed ends allowing the circuit board to be inserted at an angle with respect to its final contacting position, resilient first and second detent means on said housing at opposite ends of said opening for locking the circuit board in its final position upon rotation of the circuit board about an axis parallel to the elongation of said opening, said detent means engaging and biasing the circuit board with opposed spring forces parallel to the elongation of said opening when the circuit board is in its final position, and said first and second detent means having different spring characteristics so as to produce upon their deflection a net axial force in one direction of the elongation of said opening on the circuit board so as to press the circuit board in one direction parallel to the elongation of said opening into a fixed reference position.

* * * * *